US006679732B2

(12) United States Patent
Mikami et al.

(10) Patent No.: US 6,679,732 B2
(45) Date of Patent: Jan. 20, 2004

(54) DATA-PROCESSING APPARATUS WITH WIRE HARNESS AND FERRITE CORE

(75) Inventors: Masashi Mikami, Ome (JP); Tsutomu Sato, Ome (JP); Toshikatsu Nakamura, Akishima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/076,155

(22) Filed: Feb. 12, 2002

(65) Prior Publication Data

US 2002/0111072 A1 Aug. 15, 2002

(30) Foreign Application Priority Data

Feb. 13, 2001 (JP) ..... 2001-035245

(51) Int. Cl.[7] ..... H01R 13/66
(52) U.S. Cl. ..... 439/620; 174/36
(58) Field of Search ..... 439/620, 165; 174/36

(56) References Cited

U.S. PATENT DOCUMENTS 6,252,163 B1 * 6/2001 Fujimori ..... 174/36
6,479,753 B2 * 11/2002 Borg et al. ..... 174/36

FOREIGN PATENT DOCUMENTS

JP 2000-332428 11/2000

* cited by examiner

*Primary Examiner*—Neil Abrams
(74) *Attorney, Agent, or Firm*—Foley & Lardner

(57) ABSTRACT

A notebook PC has a main unit and a display unit. The main unit incorporates a power-supply circuit and a display control circuit. The display unit comprises an LCD panel and a backlight. The main unit and display unit are electrically connected by an LCD harness. The LCD harness extends through a hinge mechanism that couples the display unit to the main unit, allowing the display unit to rotate. The LCD harness comprises lines including power lines and signal lines. The power lines supply power from the power-supply circuit to the LCD panel and the backlight. The signal lines supply data from the display control circuit to the LCD panel. A ferrite core wraps only the signal lines.

20 Claims, 4 Drawing Sheets

DATA-PROCESSING APPARATUS WITH WIRE HARNESS AND FERRITE CORE

CROSS-REFERENCE To RELATED APPLICATIONS

This application is based upon and claims the benefit of priority from the prior Japanese Patent Application No. 2001-035245, filed Feb. 13, 2001, the entire contents of which are incorporated herein by reference.

BACKGROUND OF THE INVENTION

1. Field of the Invention

The present invention relates to a data-processing apparatus that comprises a cable for transmitting data at high speed between a plurality of units. More particularly, the invention relates to a notebook-type personal computer (hereinafter referred to as "notebook PC") that has signal lines for transmitting data to a liquid crystal display (hereinafter referred to as "LCD") so that the LCD may display the data.

2. Description of the Related Art

In recent years, the clock frequency and the data-transmitting speed in the system buses have increased in notebook PCs. In notebook PCs, electromagnetic waves emanating from particular components are more intense than before. The electromagnetic waves adversely influence the other components of the notebook PC. The influence of electromagnetic waves is known as "electro-magnetic interference," or "EMI."Most notebook PCs incorporate means for protecting the components from EMI.

Most notebook PCs have a main unit and an LCD unit. The main unit has a keyboard on its upper surface. A hinge mechanism connects the LCD unit to the main unit, allowing the LCD unit to rotate. An LCD harness electrically connects the main unit and the LCD unit. The LCD harness is a bundle of lines and extends from the main unit into the LCD unit through the hinge mechanism. The LCD harness includes power lines, signal lines, and the like. The power lines can supply power to the LCD unit from the power-supply circuit provided in the main unit. The signal lines can supply data to the LCD unit from the display control circuit incorporated in the main unit.

A ferrite core, which is a hollow magnetic cylinder, wraps the LCD harness. The ferrite core minimizes not only the EMI caused by electromagnetic waves emanating from any component outside the LCD harness, but also the EMI caused by the electromagnetic waves emanating from, in particular, the signal lines included in the LCD harness In the ferrite core, the signal lines and the power lines are bundled together. The electromagnetic waves emanating from the signal lines inevitably influence the power lines. Thus, the ferrite core cannot suppress the EMI ("noise") with as high an efficiency as is desired. The ferrite core is disadvantageous in another respect. It wraps the entire LCD harness, though it needs to wrap only the signal lines that generate electromagnetic waves. Thus, the ferrite core has an unnecessarily large inside diameter and inevitably occupies a large space.

BRIEF SUMMARY OF THE INVENTION

The present invention has been made in view of the foregoing. Embodiments of the invention provide a data-processing apparatus that can efficiently inhibit EMI of electromagnetic waves.

A data-processing apparatus according to one embodiment of the invention comprises: a first unit comprising a power supply and a signal source; a second unit; a harness electrically connecting the first unit and the second unit and comprising a plurality of lines including power lines which supply power from the power supply to the second unit and signal lines which supply data from the signal source to the second unit; and a magnetic member wrapping only the signal lines.

A data-processing apparatus according to one embodiment of the invention comprises: a main unit comprising a power-supply circuit and a display control circuit; a display unit; a hinge mechanism which connects the display unit to the main unit, allowing the display unit to rotate; a harness electrically connecting the main unit and the display unit and comprising a plurality of lines including power lines which supply power from the power-supply circuit to the display unit and signal lines which supply data from the display control circuit to the display unit; and a magnetic member wrapping only the signal lines.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of this invention will be described in detail, with reference to the accompanying drawings.

Figure 1:
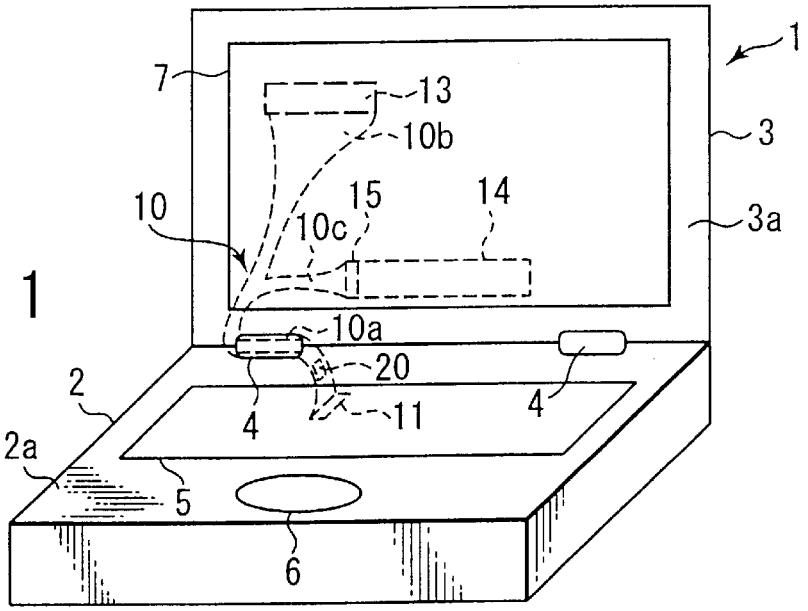
FIG. 1 is a perspective view, diagrammatically representing a notebook PC according to an embodiment of the present invention.

FIG. 1 shows a notebook PC 1, or a data-processing apparatus according to an embodiment of the present invention.

The notebook PC 1 comprises a main unit 2 (first unit) and a display unit 3 (second unit). Two hinge mechanisms 4 couple the display unit 3 to the back of the main unit 2, allowing the display unit 3 to rotate from a closed position through a range of open positions, and vice versa. At the closed position, the display unit 3 covers the upper surface 2*a* of the main body 2, with its front 3*a*. A keyboard 5 and a pointing stick 6 are provided on the upper surface 2*a* of the main unit 2. The keyboard 5 has a plurality of input keys. An LCD panel 7 is mounted on the front 3*a* of the display unit 3.

An LCD harness 10 electrically connects the main unit 2 and the display unit 3. More precisely, in one embodiment the LCD harness 10 comprises three sections, section 10*a*, section 10*b* and section 10*c*. LCD harness 10 is connected at one end to the connector 11 mounted on the circuit board 12 (FIG. 2) that is incorporated in the main unit 2. The other end of the LCD harness 10 branches into two sections, section 10*b* and section 10*c*, in the display unit 3. Section 10*b* is connected to the connector 13 provided on the LCD panel 7. Section 10*c* is connected to the connector 15 provided on the backlight 14 that is incorporated in the display unit 3. Section 10*a* of the LCD harness 10 extends through one of the hinge mechanisms 4.

Other embodiments of the present invention may employ an LCD harness having a different configuration, depending on the hardware configuration of the particular data-processing apparatus in which the LCD harness is used. For example, in one embodiment the end of a particular LCD harness located in the main unit may have two or more sections. Similarly, the end of a particular LCD harness located in the display unit may have only one section or may have three or more sections.

Thus, LCD harness 10 represents only one possible configuration of an LCD harness that may be employed with embodiments of the present invention. Other LCD harness configurations are within the teachings of the present invention, without departing from the scope and spirit of the present invention.

Figure 2:
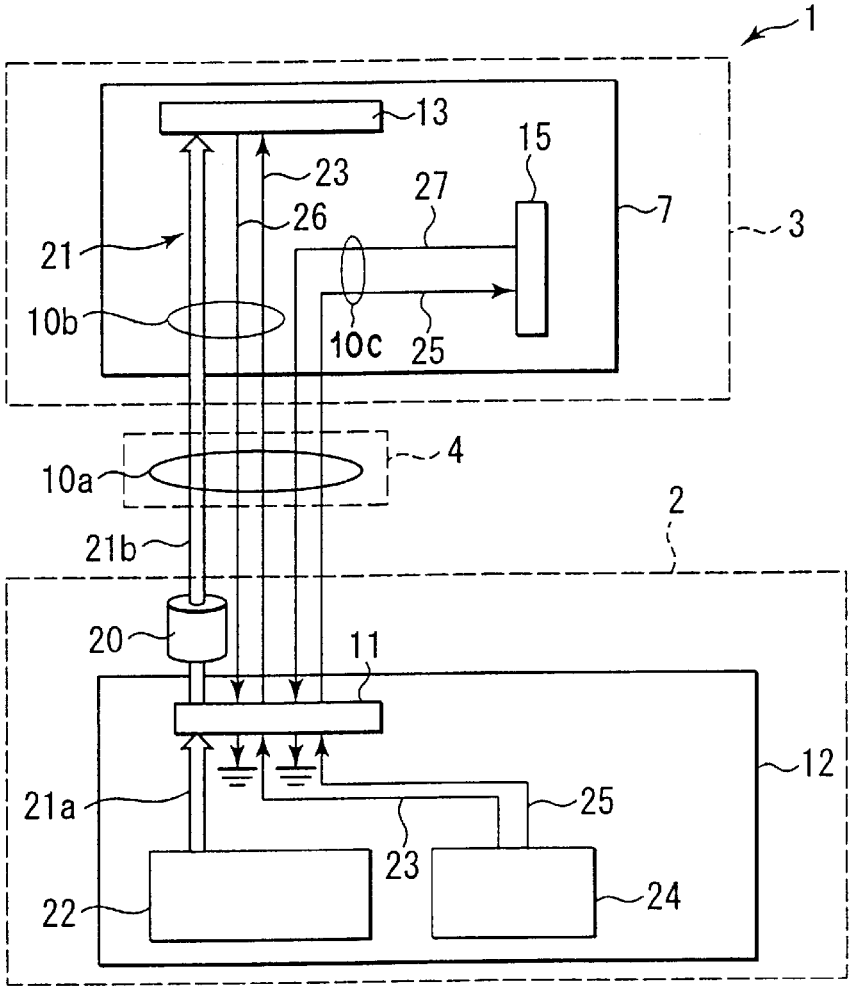
FIG. 2 is a diagram showing the connection of wires in the LCD harness that is incorporated in the notebook PC of FIG. 1.

As FIG. 2 shows, a display control circuit 22 and a power-supply circuit 24 are mounted on the circuit board 12 in main unit 2 (shown as dashed line 2 in FIG. 2), together with the connector 11. The display control circuit 22 transmits data to the LCD panel 7 in display unit 3 (shown as dashed line 3 in FIG. 2) via the signal lines 21 (depicted as a single arrow in FIG. 2) that are included in the LCD harness 10.

The signal lines 21 are connected at one end to the display control circuit 22 on circuit board 12 in main unit 2. Signal lines 21 then extend from the display control circuit 22 as portion 21*a* of signal lines 21 and pass through connector 11. Signal lines 21 then pass through ferrite core 20 as portion 21*b* of signal lines 21. Signal lines 21 then pass out of main unit 2 and through hinge mechanism 4 (shown as dashed line 4) bundled with power lines 23 and 25 and ground wires 26 and 27 in section 10*a* of LCD harness 10 and into display unit 3. Signal lines 21 then connect to connector 13 in LCD panel 7.

The power-supply circuit 24 supplies power to the LCD panel 7 and the backlight 14 via the power lines 23 and 25 that are included in the LCD harness 10. The power lines 23 and 25 are connected at one end to the power-supply circuit 24 on circuit board 12 in main unit 2. The power lines 23 and 25 then extend from the power-supply circuit 24 and pass through connector 11. The power lines 23 and 25 then pass out of main unit 2 and through hinge mechanism 4, bundled with ground wires 26 and 27 and signal lines 21 in section 10*a* of LCD harness 10, and into display unit 3.

The power line 23 then branches into section 10*b* of the LCD harness 10 and connects to connector 13 in LCD panel 7. The power line 25 branches into section 10*c* of the LCD harness 10 and connects to connector 15 in LCD panel 7.

The LCD harness 10 further includes the two ground. wires 26 and 27. The ground wire 26 is connected at one end to the connector 13. The ground wire 26 then extends from the connector 13 in section 10*b* of LCD harness 10 and passes through hinge mechanism 4 bundled. with ground line 27, power lines 23 and 25 and signal lines 21 in section 10*a* of LCD harness 10. The ground wire 26 then enters main unit 2 and passes through the connector 11 and is connected at the other end to the ground.

The ground wire 27 is connected at one end to the connector 15. The ground wire 27 extends from the connector 15 in section 10*c* of LCD harness 10 and passes through hinge mechanism 4 bundled with ground line 26, power lines 23 and 25 and signal lines 21 in section 10*a* of LCD harness 10. The ground wire 27 then enters main unit 2 and passes through the connector 11 and is connected at the other end to the ground. Thus, the ground wires 26 and 27 connect the LCD panel 7 and the backlight 14 to the ground, respectively.

In the present invention, eight low-voltage differential signal (LVDS) lines are used as signal lines 21. The LVDS lines can transmit data at high speed. Other embodiments may use more or less LVDS lines as signal lines, depending, for example, on the hardware configuration of the data-processing apparatus.

Figure 3:
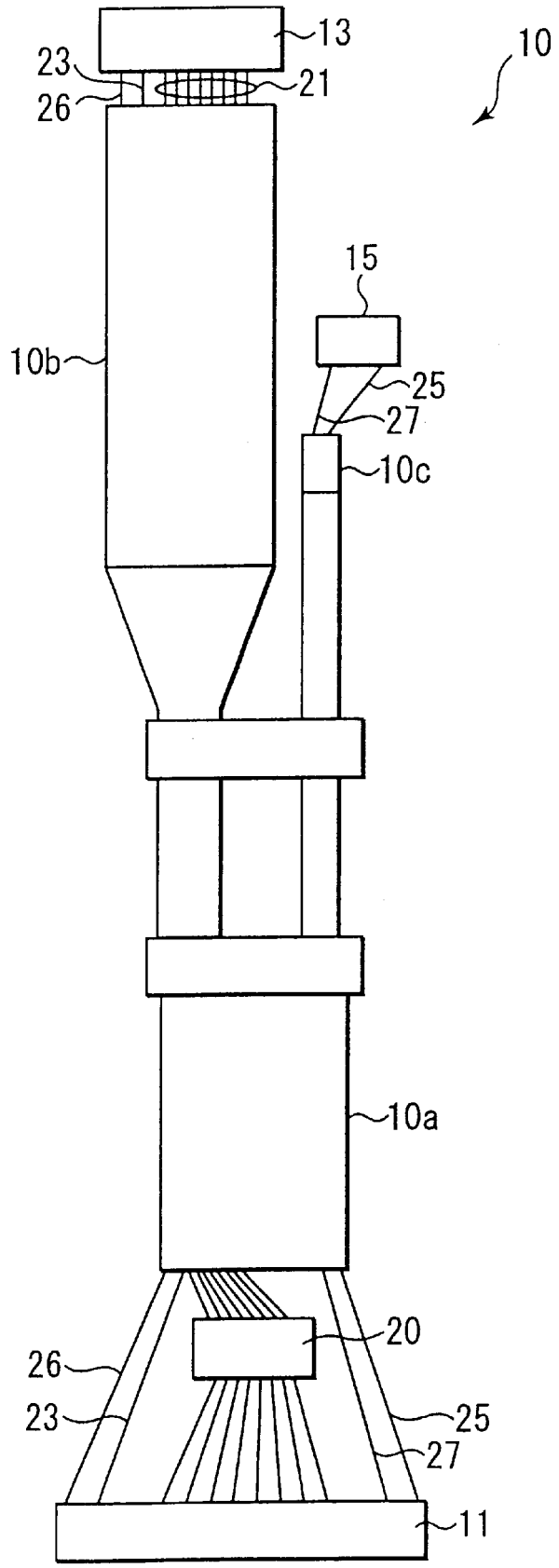
FIG. 3 is a schematic representation of the LDC harness.

FIG. 3 is a schematic representation of the LCD harness 10. FIG. 3 shows the three sections 10*a*, 10*b* and 10*c* of LCD harness 10. As described above in relation to FIG. 2, the first section 10*a* is a bundle of eight signal lines 21, two power lines 23 and 25 and two ground wires 26 and 27. The second section 10*b* lies in the display unit 3 and is a bundle of the eight signal lines 21, the power line 23 and the ground wire 26. The third section 10*c* lies in the display unit 3 and is a bundle of the power line 25 and the ground wire 27. As shown in FIG. 2, the first section 10*a*, which is a bundle of all lines included in the harness 10, passes through one hinge mechanism 4.

According to embodiments of the invention, of the 12 lines bundled into the LCD harness 10, only the eight signal lines 21 that radiate electromagnetic waves and cause EMI are sealed in the ferrite core 20. Ferrite core 20 is a hollow cylinder made of magnetic material. The ferrite core 20 may be used to reduce signal line 21 noise. As an example, in one test, signal line 21 noise without ferrite core 20 was measured as 34.5 dB. In contrast, after signal line 21 was wrapped by ferrite core 20, the signal line 21 noise was reduced to 27.2 dB.

Examples of a ferrite core 20 that may be used in embodiments of the present invention include, but are not limited to, "Toroidal Cores" manufactured by Tokin Corporation. As a more specific example, toroidal core model number ESD-R-10D, listed on page 112 of the Tokin EMC catalogue 2001, may be used. This toroidal core has an inside diameter of 5.0 millimeters (mm), an outer diameter of 9.5 mm, and a thickness of 10.0 mm. Toroidal cores with different dimensions than those of model number ESD-R-10D may be used in other embodiments of the present invention. The toroidal cores used in embodiments of the present invention may have a range of magnetic permeability of about 700 to 1400.

In the embodiment of the present invention shown in FIGS. 2 and 3, the ferrite core 20 wraps those parts 21*b* of the signal lines 21, which extend between the first section 10*a* of the LCD harness 10 and the connector 11 mounted on the circuit board 12. The ferrite core 20 therefore inhibits the EMI of the electromagnetic waves emanating from the signal lines 21. In one embodiment, the ferrite core 20 may be wrapped around the signal lines 21 by extracting from connector 11 the pins associated with the signal lines 21, threading the signal lines 21 through the ferrite core 20, and re-inserting the pins into connector 11.

Figure 4:
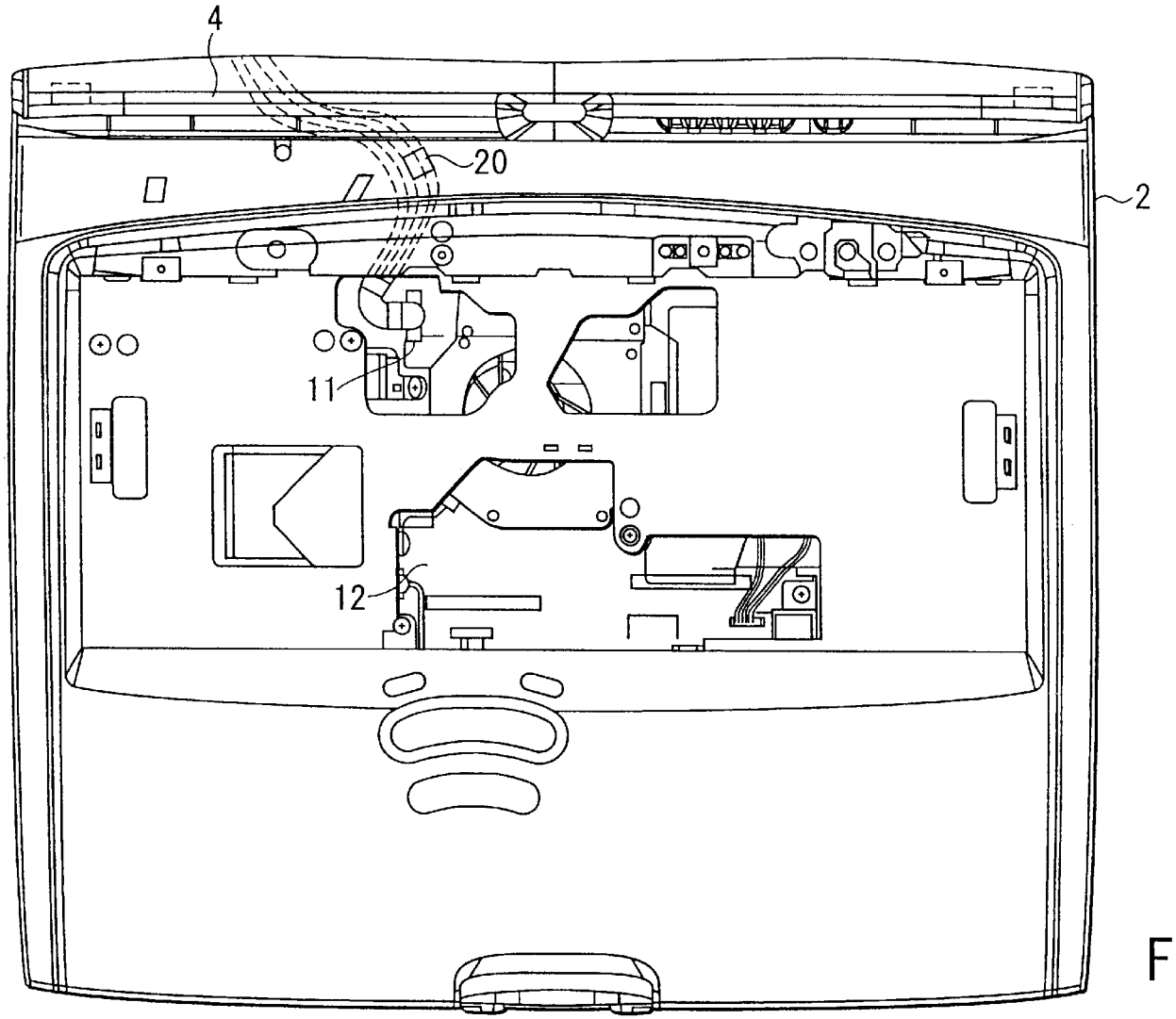
FIG. 4 is a plan view of the main unit of the notebook PC, from which the keyboard has been removed.

As FIG. 4 shows, in one embodiment the ferrite core 20 is provided in the main unit 2. More specifically, the ferrite core 20 extends between the connector 11 and the hinge mechanism 4 and wraps the eight signal lines 21 on the end of the LCD harness 10 that is connected to the connector 11. The connector 11 is arranged on the circuit board 12 incorporated in the main unit 2.

This positioning of the ferrite core 20 in close proximity to connector 11 has additional benefits. Display control circuit 22 (shown in FIG. 2) on circuit board 12 is located near connector 11 and is the source of data to be displayed on LCD panel 7. Because ferrite core 20 is wrapped around the signal lines 21 that are located in close proximity to connector 11 and the display control circuit 22, electromagnetic waves emanating from the display control circuit 22 are inhibited from interfering with signal lines 21.

Other embodiments of the present invention may provide the ferrite core 20 at other locations on the LCD harness 10. For example, the ferrite core 20 may be positioned in close proximity to connector 13 in display unit 3. This position of the ferrite core 20 may be advantageous, for example, if there is a source of EMI near connector 13. Yet other embodiments may include ferrite cores similar to ferrite core 20 on each end of LCD harness 10.

Figure 5:
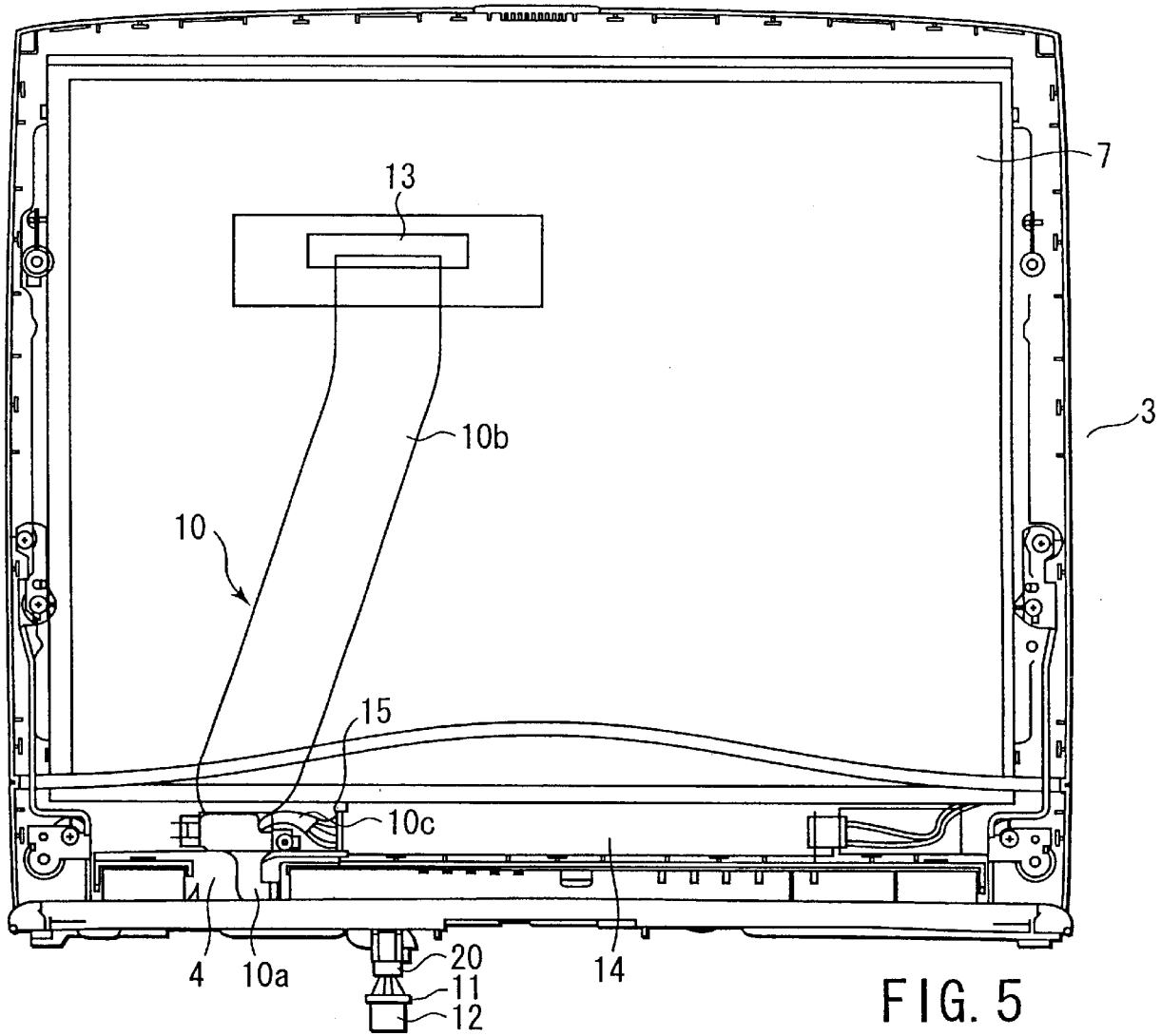
FIG. 5 is a plan view of the display unit of the notebook PC, illustrating the internal structure of the display unit.

As seen from FIG. 5, section 10*a* of the LCD harness 10 extends through one of the hinge mechanisms 4. The LCD harness 10 then branches into two sections in the display unit 3. Section 10*b* is connected to the connector 13 mounted on the LCD panel 7. Section 10*c* is connected to the connector 15 provided on the backlight 14. Ferrite core 20, connector 11 and circuit board 12 are shown in FIG. 5 outside of main unit 2 in order to better show their relation to display unit 3. However, it is understood that in the present embodiment ferrite core 20, connector 11 and circuit board 12 are located in the main unit 2.

As specified above, the ferrite core 20 wraps only the eight signal lines 21 of the LCD harness 10 that electrically connects the display unit 3 to the main unit 2. Therefore, in embodiments of the present invention, ferrite core 20 can inhibit EMI more efficiently than in the conventional case where a ferrite core wraps all lines of the LCD harness. That is, by wrapping only the signal lines 21, the ferrite core 20 protects the power lines (23 and 25) and the ground wires (26 and 27) from the EMI of the electromagnetic waves emanating from the signal lines 21. Moreover, the ferrite core 20 can inhibit the EMI efficiently, because it wraps only the signal lines 21 and therefore has a smaller inside diameter.

Thus, the ferrite core 20 can have a smaller inside diameter than its counterpart provided in the conventional notebook PC, which wraps not only signal lines, but also power lines and ground wires. This allows the notebook PC 1 employing embodiments of the present invention to be smaller than the conventional notebook PC.

In further embodiments, an additional advantage is realized by wrapping the ferrite core 20 around signal lines in close proximity to sources of EMI, such as display control circuit 22 in main unit 2. Thus, any EMI caused by the display control circuit 22 or other EMI source may not interfere with the signal lines.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

A notebook PC that has an LCD harness 10 comprising lines, only some of which are wrapped in a ferrite core 20. Nonetheless, the present invention is not limited to such a notebook PC. Rather, it may be applied to any other data-processing apparatus that comprises a plurality of electronic devices, a harness connecting the electronic devices, and a ferrite core wrapping the signal lines included in the harness and not wrapping any other lines included in the harness. In this data-processing apparatus, too, the ferrite core can efficiently inhibit EMI of electromagnetic waves emanating from the signal lines.

What is claimed is:

1. A data-processing apparatus comprising:

a main unit;

a display unit;

a display control circuit provided in the main unit;

a hinge connecting the main unit and the display unit such that each of the main unit and the display unit is rotatable;

an LCD provided in the display unit;

a harness including power supply lines and signal lines for transmitting data to be displayed on the LCD, and extending through the hinge to connect the display control circuit and the LCD;

a ferrite core surrounding only the signal lines;

wherein the ferrite core is provided in the main unit, and surrounds portions of the signal lines which are located between the display control circuit and the hinge.

2. A data-processing apparatus according to claim 1, wherein the ferrite core is cylindrical.

3. A data-processing apparatus according to claim 2, wherein the ferrite core has an inside diameter smaller than an inside diameter required to wrap the plurality of lines.

4. A data-processing apparatus according to claim 2, wherein the ferrite core has an inside diameter sufficient to wrap only the signal line.

5. A data-processing apparatus according to claim 2, wherein the ferrite core has an inside diameter of about 5.0 millimeters.

6. A data-processing apparatus according to claim 2, wherein the ferrite core has a magnetic permeability in a range of about 700 to 1400.

7. A data-processing apparatus according to claim 2, wherein the ferrite core is provided close to the display control circuit.

8. A data-processing apparatus according to claim 1, wherein the harness includes a ground wire.

9. A data-processing apparatus according to claim 1, wherein the signal line is a low-voltage differential signal (LVDS) line.

10. A data-processing apparatus according to claim 1, wherein the signal line comprises a plurality of low-voltage differential signal (LVDS) lines.

11. A data-processing apparatus comprising:

a main unit comprising a power-supply circuit and a display control circuit;

a display unit;

a hinge mechanism which connects the display unit to the main unit, allowing the display unit to rotate;

a harness electrically connecting the main unit and the display unit and comprising a plurality of lines includ ing a power line which supplies power from the power-supply circuit to the display unit and a signal line which supplies data from the display control circuit to the display unit; and a magnetic member wrapping only the signal line.

12. A data-processing apparatus according to claim 11, wherein the magnetic member is a hollow cylindrical ferrite core.

13. A data-processing apparatus according to claim 12, wherein the ferrite core has an inside diameter smaller than an inside diameter required to wrap the plurality of lines.

14. A data-processing apparatus according to claim 12, wherein the ferrite core has an inside diameter sufficient to wrap only the signal line.

15. A data-processing apparatus according to claim 11, wherein the harness extends through the hinge mechanism.

16. A data-processing apparatus according to claim 12, wherein the ferrite core wraps a portion of the signal line which lies between the display control circuit and the hinge mechanism.

17. A data-processing apparatus according to claim 16, wherein the ferrite core is provided in the main unit and located in close proximity to the display control circuit.

18. A data-processing apparatus according to claim 11, wherein the harness includes a ground wire.

19. A data-processing apparatus according to claim 11, wherein the signal line is a low-voltage differential signal (LVDS) line.

20. A data-processing apparatus according to claim 11, wherein the signal line comprises a plurality of low-voltage differential signal (LVDS) lines.

* * * * *